United States Patent [19]

Lincourt

[11] Patent Number: 4,482,030

[45] Date of Patent: Nov. 13, 1984

[54] SUPPORT PLATFORM

[76] Inventor: William R. Lincourt, 54 E. Bowery St., Newport, R.I. 02840

[21] Appl. No.: 535,046

[22] Filed: Sep. 23, 1983

[51] Int. Cl.[3] ..... E06C 7/16; E06C 7/08

[52] U.S. Cl. ..... 182/121; 248/238

[58] Field of Search ..... 182/121, 122, 120; 248/238

[56] References Cited

U.S. PATENT DOCUMENTS

| | | | |
|---|---|---|---|
| 169,236 | 10/1875 | Case et al. | 182/121 |
| 407,079 | 7/1889 | Laskey | 182/121 |
| 3,511,338 | 5/1970 | Chapman | 182/121 |
| 3,792,750 | 2/1974 | Madison | 182/121 |
| 3,899,045 | 8/1975 | Geisel | 182/121 |
| 4,085,819 | 4/1978 | Ohnstad | 182/121 |

FOREIGN PATENT DOCUMENTS

| | | | |
|---|---|---|---|
| 516360 | 1/1953 | Belgium | 182/121 |

*Primary Examiner*—Reinaldo P. Machado

*Attorney, Agent, or Firm*—Barlow & Barlow

[57] ABSTRACT

A support platform for a ladder is disclosed which is arranged to be assembled with eight bolts by placing a platform on to a pair of straps which have hook members at either end thereof. Further, a spreader bar, that serves as a handle, is fastened across the upper portions of the straps so that the upper portion is stiffened. A leg is spaced inwardly from the hooks at either end of the straps to provide guidance of the platform onto the rungs of the ladder; leg portions are elongated for the purpose of proper engagement with the rungs of the ladder.

1 Claim, 3 Drawing Figures

SUPPORT PLATFORM

BACKGROUND OF THE INVENTION

The present invention relates to an improved support platform for a ladder which has side rails and a plurality of rungs and which is generally vertically disposed. In the past various types of platforms have been proposed for ladders to permit a person working on a ladder to stand without the usual foot discomfort. For example, reference is made to the Case et al Patent, U.S. Pat. No. 169,236, and the Laskey Patent, U.S. Pat. No. 407,079. These prior platforms, while capable of performing their intended function, are difficult to maneuver and move from one set of rungs to another set of rungs. Essentially, they do not provide any means for permitting a person standing on a ladder from not only moving the platform but locating the same on a next upper of lower set of rungs with ease. This is a serious detriment to the successful commercialization of such a platform.

SUMMARY OF THE INVENTION

The istant invention provides a safety platform which overcomes the above defects and includes a hook construction with an elongated portion thereof together with a spreader bar, which can serve not only as a handle but also as a member to reinforce the straps. The improved safety platform also includes a generally horizontal platform member which is essentially supported on a pair of spaced straps at opposite ends of the platform, each strap extending across the bottom of the platform and then bent upwardly in an acute angle to a terminus thereof where an L-shaped hook is formed. L-shaped leg portions are affixed to the straps at the ends thereof spaced inwardly from the hook members. These L-shaped leg portions are elongated and extend downwardly to permit the leg portions to engage the rung of the ladder as the platform is moved toward the rung.

The safety platform may be made from steel straps and the hooks and leg portions likewise can be made from steel straps, the upper hook being suitably reinforced with a member extending over to the strap essentially at the location of the spreader bar. The materials permit the platform to be manufactured and marketed at competitive prices.

Accordingly, the primary object of the present invention is to provide an improved safety platform for use on an attachment between two adjacent rungs of a conventional ladder of either the round rung or flat rung type. Another object of the present invention is to provide an improved support platform where the platform was provided with a spreader bar for gripping the same and allowing easy movement to adjacent rungs of a ladder.

DETAILED DESCRIPTION OF THE PREFERRED EMBODIMENT

Figure 1:
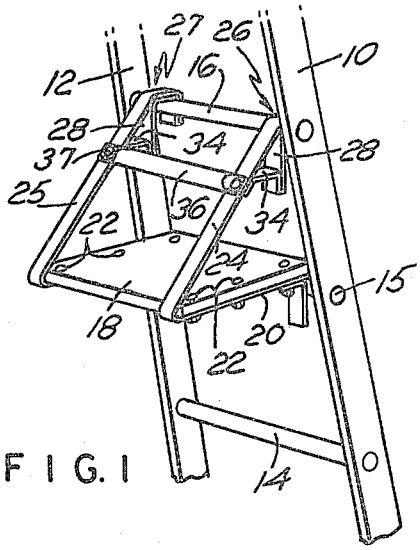
FIG. 1 is a perspective view showing the improved support platform of the present invention mounted between two adjacent rungs of a conventional ladder.

A conventional ladder having side rails 10 and 12, and rungs 14, 15 and 16 is illustrated in FIG. 1. By way of example, the ladder is shown as having round rungs although the rungs could be rectangular or flat metal since the device of the instant invention is adapted to be utilized on either round or flat metal rungs. The support platform includes a platform member 18, that may be made from a sheet of plywood or any other convenient material, which platform 18 is held in position by a pair of straps that have a first portion as at 20, that is secured to and extends across the bottom of platform 18 to terminate in a downwardly bent end 21 that forms a hook member, the strap being secured to the platform by a plurality of bolts 22 (see FIG. 3). Each of the straps is then bent upwardly at an acute angle to provide an upwardly directed portion 24 and 25. At the terminus of each of the portions 24 and 25 there is provided an L-shaped hook member 26 and 27 having a top portion 31 and a downwardly bent portion 32 and which includes a reinforcing and guiding member consisting of a downwardly extending elongated leg portion such as 28, a top portion 29, and a downwardly turned hook portion 30. As seen in the drawings, the reinforcing member follows the contour of the hook in face engagement therewith. For stiffening purposes a bracket member 34 extends rearwardly from the leg 28 to the strap; and as seen in the drawing, each of these parts is welded to the other, weld indications appearing as for example, delineated by the letter "W" throughout the drawings.

A spreader bar 36 extends between the upwardly directed portions of the straps 24 and 25 and is located a slight distance below the terminus of the straps, and is affixed thereto by bolts 37, 37' at the flattened ends thereof. An angle iron of L shape consisting of a downwardly directed leg portion 38 and top portion 39 is fastened to the underside of the straps 20 and 21 and acts as a locating or guiding member along with the leg 28 to aid in placing the platform on the ladder rungs.

Figure 2:
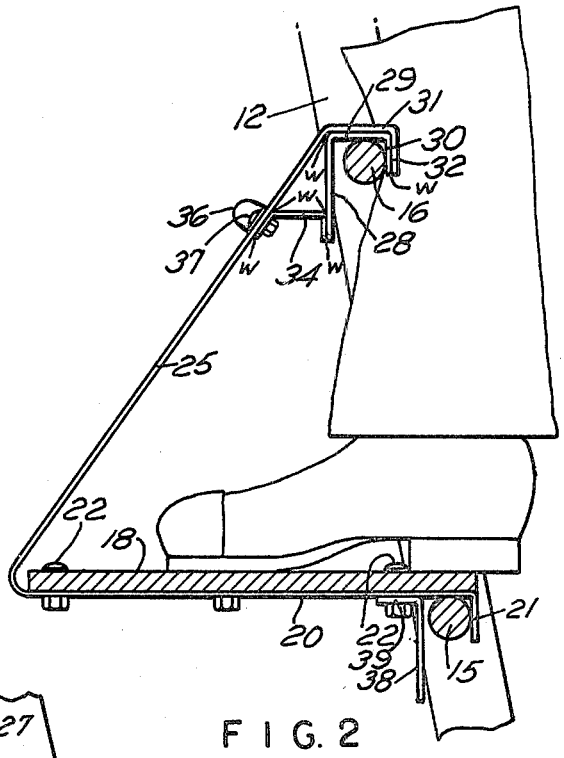
FIG. 2 is a side elevational view thereof partly in section showing the manner in which the platform is used.
Figure 3:
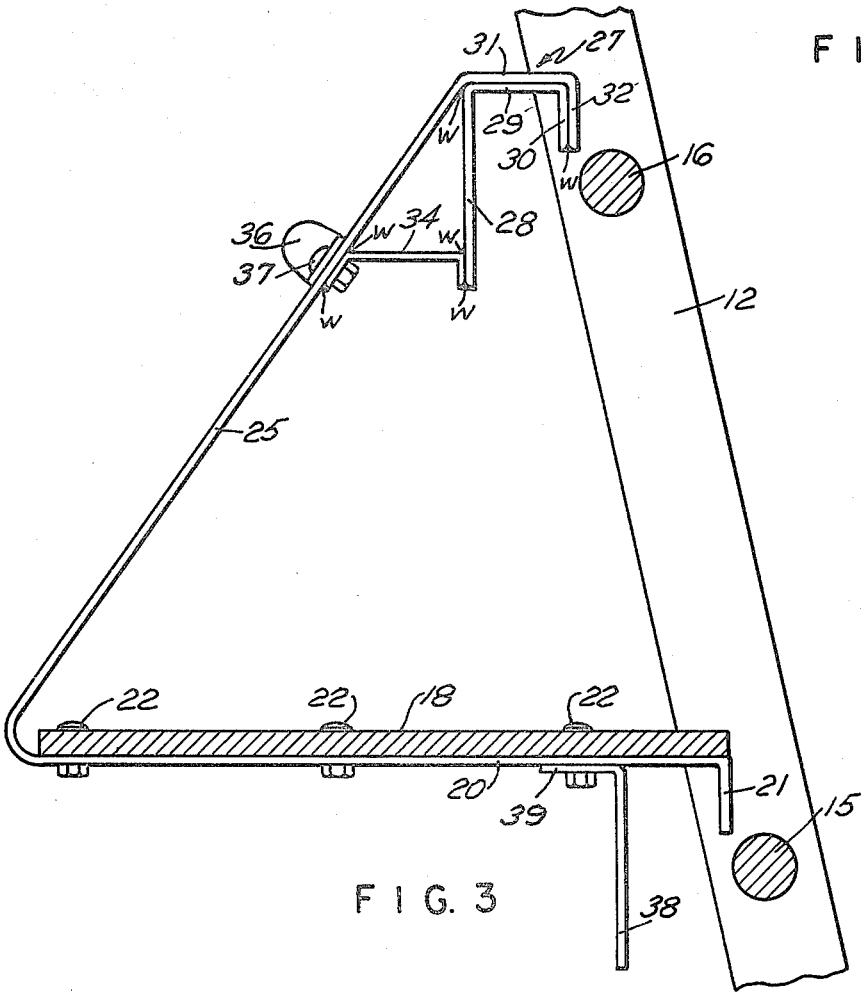
FIG. 3 is detached side view of the invention illustrating the manner in which the platform may be moved on to or away from the rungs of the ladder.

As can be readily appreciated, particularly by referring to FIG. 3, all one has to do to move the support platform from one location to another, is to step off the platform on to a lower rung, grasp the support platform by the spreader bar 36, and lift the same upwardly until it clears the rung. If it is to be moved upwardly, then the platform is moved upwardly to another set of adjacent rungs and then moved toward the rungs so that the downwardly directed members as for example, the illustrated downwardly directed members 28 and 38 will engage the rungs and then the platform may be dropped into place from which position it is secured by the hooks on the rungs and then may be placed in to use as seen in FIG. 2.

I claim:

1. An improved support platform for a ladder with side rails and a plurality of rungs comprising:

a platform;

a pair of straps at opposite ends of the platform, each strap extending from one edge thereof across the bottom of the platform and thence bent at an acute angle upwardly to a terminus;

first hook members formed from said straps and located at the upper terminus of the straps for engaging an upper rung of a ladder;

reinforcing and guiding members, each having portions in face engagement with the first hook members and having an elongated leg spaced inwardly from the extremity of the hook member to guide the hook member on to a rung;

second hook members located at the lower terminus of the straps for engaging the lower rungs of the ladder;

second L-shaped members affixed inwardly from said second hook members and having elongated leg portions extended downwardly beyond the terminal end of the second hook members to engage the run and guide the second hook members onto a rung;

a spreader bar fastened between the upwardly extending portions of the straps below the terminus thereof, the bar serving as a stiffening member as well as a handle to move the platform.

* * * * *